United States Patent [19]

Godell

[11] Patent Number: 4,971,161

[45] Date of Patent: Nov. 20, 1990

[54] ICE AUGER CONVERSION KIT

[76] Inventor: Richard P. Godell, 30119 Halecreek, Romulus, Mich. 48174

[21] Appl. No.: 432,373

[22] Filed: Nov. 6, 1989

[51] Int. Cl.[5] ..... B25F 3/00; E21B 10/44

[52] U.S. Cl. ..... 175/18; 30/122; 56/2; 56/DIG. 9; 172/14; 172/247; 175/394; 403/306

[58] Field of Search ..... 56/2, DIG. 9; 175/18, 175/87, 394; 299/24, 87; 172/14, 41, 247, 253; 30/122, 276, 500; 408/20; 403/300, 306, 296, 378

[56] References Cited

U.S. PATENT DOCUMENTS

| | | | |
|---|---|---|---|
| 2,729,067 | 1/1956 | Patterson | 175/394 X |
| 3,198,266 | 8/1965 | Mishler . | |
| 3,602,321 | 8/1971 | Kortschaga | 175/18 |
| 3,705,632 | 12/1972 | Burke | 173/27 |
| 3,710,877 | 1/1973 | Michasin | 175/18 |
| 3,731,751 | 5/1973 | Rusco | 173/26 |
| 4,286,675 | 9/1981 | Tuggle | 30/276 X |
| 4,501,332 | 2/1985 | Straayer | 172/41 |
| 4,752,256 | 6/1988 | Dorion | 30/122 X |

FOREIGN PATENT DOCUMENTS

| | | | |
|---|---|---|---|
| 1203363 | 1/1960 | France | 175/394 |
| 2593662 | 8/1987 | France | 172/41 |

*Primary Examiner*—Ramon S. Britts
*Assistant Examiner*—David J. Bagnell
*Attorney, Agent, or Firm*—Leon Gilden

[57] ABSTRACT

An ice auger conversion kit is mounted to a conventional grass-timming apparatus that includes an engine mounted rearwardly of a drive shaft housing with a drive shaft mounted therethrough. The forward end of the drive shaft is of a square drive configuration and is received within a square bore of a rotatable boss coaxially mounted through an adapter head, wherein a forwardmost end of the adapter head includes an axially extending threaded second boss for mounting the ice auger cutting head. The adapter head includes a series of gears to effect a gear reduction therethrough to enhance torque and effect appropriate speed of the ice auger head in use.

7 Claims, 1 Drawing Sheet

10
10a
11
12
13
13a
14
15
16
17
18
19
19a
20
21
21a
22
23
24
25
26
27
28
29
29a
30
31
32
33
34
35
36
37
38
39
40
41
42
43
44
45

ICE AUGER CONVERSION KIT

BACKGROUND OF THE INVENTION

1. Field of the Invention

The field of invention relates to ice auger devices, and more particularly pertains to a new and improved ice auger conversion kit adaptable to grass-trimming apparatus.

2. Description of the Prior Art

Ice augers are known in the prior art and have been extensively utilized by fishermen during winter and by scientists and the like engaged in ice study. Examples of the prior art include U.S. Pat. No. 3,602,321 to Kortschaga wherein an ice auger attachment includes a pulley mounted to a remote engine of a snowmobile to power the ice auger by a belt drive from the engine to the ice auger pulley.

U.S. Pat. No. 3,710,877 to Michasiw sets forth an ice auger with an uppermost pulley for being powered by a remote engine, as in a snowmobile, as in a similar manner as set forth in the Kortschaga patent utilizing particular connection means of the ice auger and associated shafts.

U.S. Pat. No. 3,731,751 to Rusco sets forth an ice auger utilizing a drive shaft between the ice auger and a drive wheel of an associated snowmobile to utilize universal joints at each end of the drive shaft for powering the ice auger.

U.S. Pat. No. 3,705,362 to Burke sets forth an ice auger arrangement wherein an enclosed electric motor is powered by a remote battery utilizinG spaced pulleys with an enlarged housing to effect drive of the ice auger tool.

U.S. Pat. No. 3,198,266 to Mishler sets forth an ice auger, or ice fishing drill, powered by a remote battery utilizing unique frost blade arrangement in the ice auger head for cutting of the ice.

As such, it may be appreciated that there is a continuing need for a new and improved ice auger conversion kit that addresses the problems of ease of use, compactness in construction, and effectiveness in operation and in this respect, the present invention substantially fulfills this need.

SUMMARY OF THE INVENTION

In view of the foregoing disadvantages inherent in the known types of ice augers now present in the prior art, the present invention provides an ice auger conversion kit wherein the same is selectively associated with a free end of a cable drive tool directed through an adapter head to provide desired torque multiplication and coupling to an associated ice auger head. As such, the general purpose of the present invention, which will be described subsequently in greater detail, is to provide a new and improved ice auger conversion kit which has all the advantages of the prior ar& ice auger tools and none of the disadvantages.

To attain this, the present ice auger conversion kit essentially comprises an ice auger conversion kit mounted to a conventional grass-trimming apparatus that includes an engine mounted rearwardly of a drive shaft housing with a drive shaft mounted therethrough. The forward end of the drive shaft is of a square drive configuration and is received within a square bore of a rotatable boss coaxially mounted through an adapter head, wherein a forwardmost end of the adapter head includes an axially extending threaded second boss for mounting the ice auger cutting head. The adapter head includes a series of gears to effect a gear reduction therethrough to enhance torque and effect appropriate speed of the ice auger head in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ice auger conversion kit which has all the advantages of the prior art ice augers and none of the disadvantages.

It is another object of the present invention to provide a new and improved ice auger conversion kit which may be easily and efficiently manufactured and marketed.

It is a further object of the present invention to provide a new and improved ice auger conversion kit which is of a durable and reliable construction.

An even further object of the present invention is to provide a new and improved ice auger conversion kit which is susceptible of a low cost of manufacture with regard to both materials and labor, and which accordingly is then susceptible of low prices of sale to the consuming public, thereby making such ice auger conversion kits economically available to the buying public.

Still yet another object of the present invention is to provide a new and improved ice auger conversion kit which provides in the apparatuses and methods of the prior art some of the advantages thereof, while simultaneously overcoming some of the disadvantages normally associated therewith.

Still another object of the present invention is to provide a new and improved ice auger conversion kit wherein the same is selectively securable to a free terminal end of a drive shaft of a grass-trimming tool to effect power to an associated ice auger.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4:
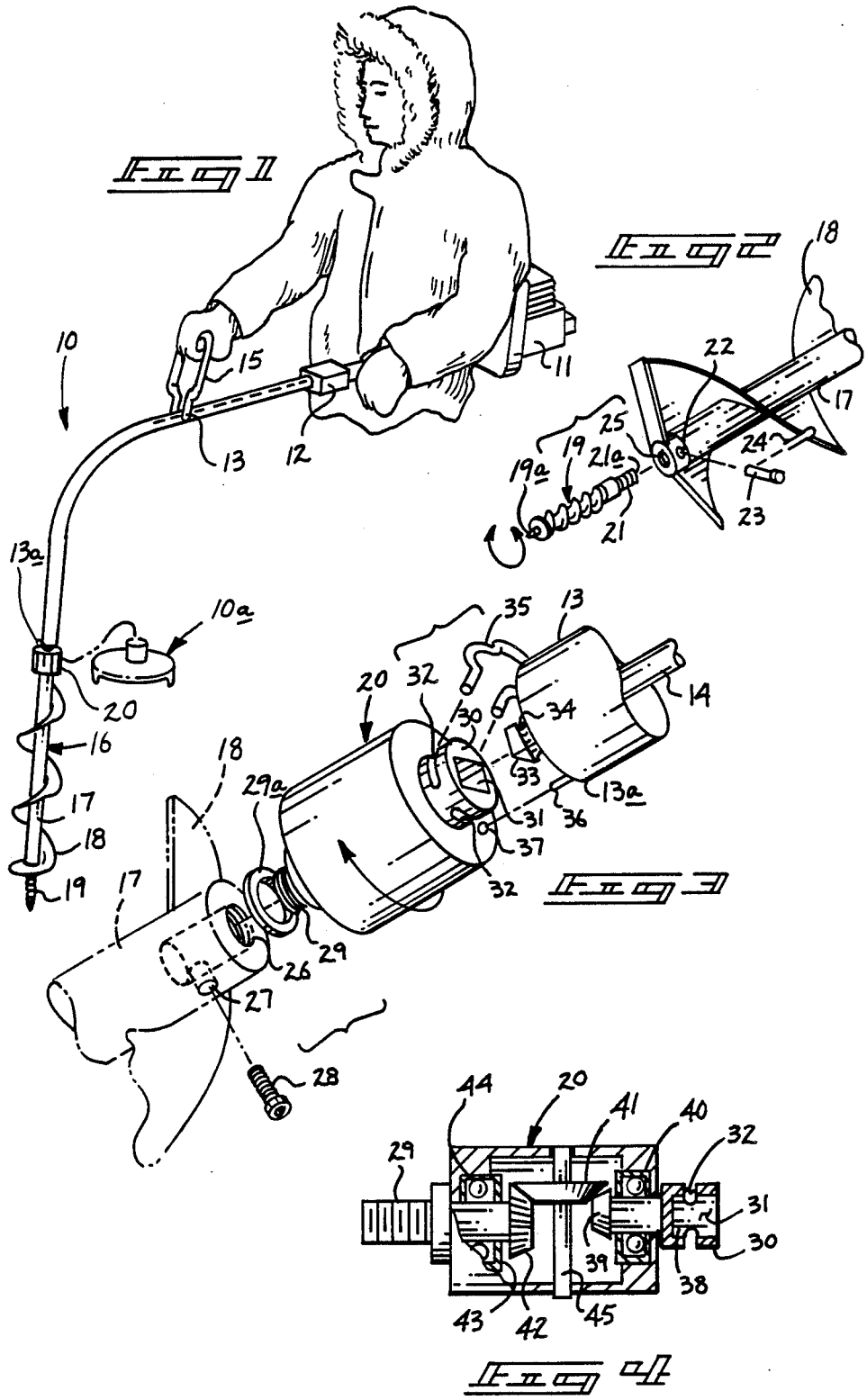
FIG. 1 an isometric illustration of the instant invention in use.
FIG. 2 is an isometric illustration of the drill guide in association with the ice auger.
FIG. 3 is an isometric illustration, somewhat exploded, of the ice auger head, adapter head, and free end of the drive shaft illustrating their relationship.
FIG. 4 is an orthographic view partially in section of the adapter head of the invention.

With reference now to the drawings, and in particular to FIGS. 1 to 4 thereof, a new and improved ice auger conversion kit embodying the principles and concepts of the present invention and generally designated by the reference numeral 10 will be described.

More specifically, the ice auger conversion kit 10 essentially comprises a combination with a grass-trimming tool utilizing a grass-trimming head 10*a* removably secured to a forward lower terminal end 13*a* of an associated arcuate support shaft 13. An engine 11 directs the flexible and rotatable drive shaft 14 to effect rotation within the support shaft 13, wherein the engine 11 is controlled by a conventional control unit 12. A handle 15 is mounted to the support shaft 13 to enhance control and direction of the organization. It is understood that the grass-trimming head 10*a* is removed relative to the free end 13*a* to enable securement of the adapter head 20 and ice auger 16 to the free end of the drive shaft 14.

The ice auger 16 comprises a central coaxial shaft with a helical cutting blade 18 formed thereabout from an upper end to a lower end thereof. Reference to FIG. 2 illustrates the lowermost end of the central shaft 17 formed with a first threaded bore 25 for receiving a threaded shank 21 extending coaxially and in alignment with a concrete guide drill 19 formed with a threaded pilot forward end 19*a* and a threaded rear shank 21 spaced from the cutting spiral of the drill formed with a shank bore 21*a* alignable with a central shaft bore 17 to receive a lock pin 23 coextensively through the aligned shank bore 21 and the shaft bore 22 with a securement key 24 positioned through a remote aperture formed within the lock pin 23 to secure the lock pin and thereby fixedly and immovably join the guide drill within the lowermost terminal end of the central shaft 17.

An adapter head 20 mounts the upper terminal end of the central shaft 17 to the lower terminal end of the support shaft 13 and comprises a cylindrical housing including a rotatable threaded lower boss 29 extending coaxially therefrom from a first terminal end of the adapter head with a rotatable upper cylindrical boss 30 extending coaxially and outwardly from an upper or second terminal end of the adapter head 20. The threaded lower boss 29 is receivable within a second threaded bore 26 coaxially aligned with the central shaft 17 and formed with an orthogonally aligned threaded locking bore 27 for receiving a lock screw 28 to secure the threaded lower boss 29 within the second threaded bore 26. A sealing ring 29*a* provided between the adapter head 29 and the shaft 17. The upper cylindrical rotatable boss 30 is formed with a square receiving boss 31 formed with diametrically opposed locking grooves 32 defining arcs less than 180 degrees each, wherein the square bore 31 receives a square drive boss 33 formed with an encircling perimeter groove 34, wherein a resilient "U" shaped lock clip 35 locks the square drive boss 33 within the square receiving bore 31 when the resilient "U" shaped lock clip 35 is in registration with the locking grooves 32 and the perimeter groove 34. A positioning pin 36 extending axially spaced from the arcuate support shaft 13 and extending orthogonally from a lower surface thereof is receivable within a positioning bore 37 axially offset from and extending orthogonally outwardly from the second end of the adapter head 20 to maintain the shaft 13 and housing of the adapter head 20 stationary to permit an internal gear reduction formed within the adapter head 20 to effect relative rotation between the square drive boss 33 and the output torque directed through the rotatable threaded lower boss 29 secured to the central shaft 17, as illustrated in FIG. 3. Reference to FIG. 4 illustrates that the upper cylindrical rotatable boss 30 includes a coaxially aligned and inwardly extending upper boss shaft 38 extending interiorly of the cylindrical housing 20 terminating at its remote end in a first bevel gear 39 defined by a first diameter with a first bearing 40 rotatably mounting the upper boss shaft 30 and its associated first bevel gear 39 within the housing. The first bevel gear 39 is in mating relationship with a second bevel gear 41 orthogonally aligned relative to the first bevel gear 39 and rotatable about a second bevel gear shaft 45 that is orthogonally mounted relative to the axis of the cylindrical housing 20. The second bevel gear 41 is defined by a second diameter within a range of three to six times the diameter of the first bevel gear 39 to maintain and effect a torque multiplication relative to the first and second bevel gears, wherein a third bevel gear 42 orthogonally aligned relative to the second bevel gear 41 and coaxially aligned relative to the first bevel gear 39 is in a one to one relationship relative to direct the torque multiplication to the output of the lower boss 29. The third bevel gear 42 is formed by a third bevel gear shaft 43 terminating in the outwardly extending threaded boss 29 mounted within a second bearing 44. It should be further noted that a space washer 29*a* is positionable about the threaded lower boss 29 to properly space the cylindrical housing 20 relative to an upper end of the central shaft 17.

In this manner, appropriate torque multiplication is directed to the ice auger to enable its boring of desired apertures within an ice sheet as desired.

As to the manner of usage and operation of the instant invention, the same should be apparent from the above disclosure, and accordingly no fur&her discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. An ice auger conversion kit apparatus comprising in combination, a motor means mounted to an upper end of a support shaft, the support shaft including a drive shaft rotatably and coaxially mounted through the support shaft in operative association with the motor means, and the support shaft including a lower end, wherein said drive shaft includes a drive shaft boss member extending coaxially beyond the lower end of the support shaft, and an adapter head receiving the drive shaft boss member at an upper end of the adapter head and wherein the adapter head includes an output shaft extending beyond a lower end of the adapter head, and an ice auger assembly lockingly receiving the output shaft at an upper end of the ice auger assembly, wherein the ice auger assembly comprises a central coaxial shaft with a single helical ice auger blade formed thereabout, and wherein the ice auger shaft includes a pilot guide drill mounted to a lower end of the ice auger shaft, and wherein the pilot drill includes a forward end defined by a threaded tapered member with a helical cutting blade formed about the pilot drill, and the pilot drill including a threaded shank coaxially formed at a rear end of the pilot drill, wherein the threaded shank includes a bore formed therethrough, and the lower end of the ice auger shaft includes a threaded bore for receiving the threaded shank of the pilot guide drill and further comprises a through-extending aperture extending orthogonally through the threaded bore, and a lock pin extending through the throughextending aperture and the bore formed within the pilot guide drill for securing and locking the pilot guide drill relative to the ice auger shaft.

2. An ice auger conversion kit apparatus as set forth in claim 1 wherein an upper end of the ice auger shaft includes a further threaded bore, and the output shaft of the adapter head includes a threaded shaft defined by threads complementary to the further threaded bore, and a threaded locking bore orthogonally directed interiorly relative to an axis defined by the further threaded bore wherein the threaded locking bore threadedly receives a lock screw therewithin to selectively lock the output shaft to the further threaded bore when the output shaft is threadedly mounted within the further threaded bore.

3. An ice auger conversion kit apparatus as set forth in claim 2 wherein the drive shaft boss member is of a square cross-sectional configuration and includes an encircling locking groove formed about an exterior surface of the drive shaft boss member, and the adapter head includes an upper boss member formed with a square receiving bore directed coaxially thereof, wherein the upper boss member is cylindrical and includes diametrically opposed locking grooves extending interiorly within the square receiving bore and a "U" shaped lock clip to engage and lock the drive shaft boss member to the upper cylindrical boss when the "U" shaped lock clip is received within the diametrically opposed locking grooves and in simultaneous registration with the encircling locking groove of the drive shaft boss member.

4. An ice auger conversion kit apparatus as set forth in claim 3 wherein the adapter head includes a torque multiplication gear set formed therewithin.

5. An ice auger conversion kit apparatus as set forth in claim 4 wherein the torque multiplication gear set comprises a first bevel gear formed and mounted orthogonally to the upper cylindrical rotatable boss and positioned interiorly of the adapter head, and a second bevel gear orthogonally mounted relative to the first bevel gear wherein the second bevel gear is rotatably mounted upon a second bevel gear shaft orthogonally directed to an axis defined by the adapter head, and a third bevel gear in cooperation with the second bevel gear at a remote end of the adapter head from the first bevel gear, wherein the third bevel gear is orthogonally mounted interiorly of the housing and includes a third bevel gear shaft, wherein the third bevel gear shaft is directed exteriorly of the adapter head to define the output shaft.

6. An ice auger conversion kit apparatus as set forth in claim 5 including a first bearing rotatably mounting the upper cylindrical rotatable boss and a second bearing mounting the third bevel gear shaft, wherein the first bearing is spaced at a remote end relative to the second bearing of the adapter head.

7. An ice auger conversion kit apparatus as set forth in claim 6 wherein the lower end of the support shaft includes a positioning pin extending beyond the lower end of the support shaft axially spaced from the drive shaft boss member and receivable within a positioning bore orthogonally formed through an upper end of &he adapter head and axially spaced from the upper cylindrical boss of the adapter head to non-rotatably secure the support shaft relative to the adapter head.

* * * * *